United States Patent [19]

Hunt

[11] 4,027,481

[45] June 7, 1977

[54] FLUID PRESSURE RESPONSIVE TRANSDUCER APPARATUS

[75] Inventor: Paulmer D. Hunt, South Bend, Ind.

[73] Assignee: The Bendix Corporation, South Bend, Ind.

[22] Filed: Dec. 11, 1975

[21] Appl. No.: 639,946

[52] U.S. Cl. ..... 60/533; 60/572; 91/49; 92/37; 137/82

[51] Int. Cl.[2] ..... F15B 7/00

[58] Field of Search ..... 60/533, 572; 92/38, 92/39, 37; 91/47, 49, 387, 460; 137/82

[56] References Cited

UNITED STATES PATENTS

| | | | |
|---|---|---|---|
| 1,384,314 | 7/1921 | Fulton | 60/533 X |
| 2,429,695 | 10/1947 | McGrath | 92/38 X |
| 2,551,274 | 5/1951 | MacDuff | 60/572 |
| 2,747,614 | 5/1956 | Gray | 92/38 |
| 2,942,838 | 6/1960 | Peters | 92/39 X |

*Primary Examiner*—Edgar W. Geoghegan

*Attorney, Agent, or Firm*—William N. Antonis; Joseph P. Kulik

[57] ABSTRACT

A fluid pressure transducer device including first fluid pressure responsive means and second fluid pressure responsive means which together define a sealed volume of fluid. The first fluid pressure responsive means is exposed to first and second input fluid pressures and responsive to variations in one or both thereof to vary the volume of the sealed volume as a function of the first input fluid pressure modified by the pressure ratio of the second input fluid pressure to the first input fluid pressure. The second fluid pressure responsive means is responsive to the changes in the sealed volume of fluid and produces an output force signal in response thereto. There may be provided a variable volume chamber containing a temperature responsive element vented to the sealed volume of fluid to cause an increase or decrease in the sealed volume to compensate for temperature variations of the sealed volume of fluid.

10 Claims, 1 Drawing Figure

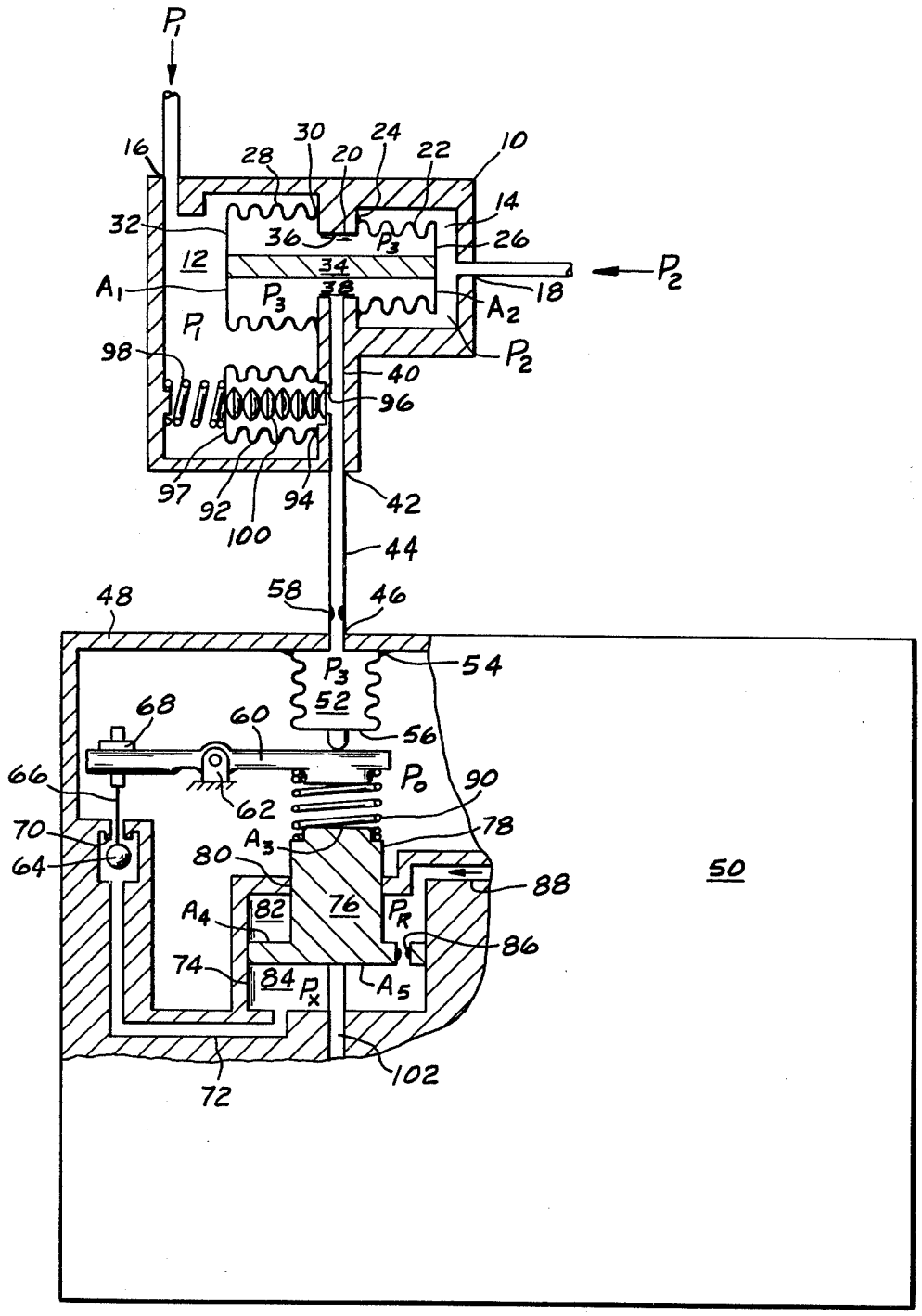
P1
16
28
30
20
24
22
10
14
32
36
P3
26
12
34
P2
A1
P3
38
18
A2
P1
98
P2
40
96
97
92
100
94
42
44
48
58
46
54
P3
52
68
60
56
66
P0
90
62
70
78
A3
64
80
88
50
A4
82
76
PR
86
74
84
Px
A5
72
102

FLUID PRESSURE RESPONSIVE TRANSDUCER APPARATUS

BACKGROUND OF THE INVENTION

Fluid pressure transducers responsive to one or more input fluid pressures and operative to produce an output signal, such as a force or a mechanical position as some function of the one or more input fluid pressures, are well known. However, in certain operating environments where size, weight, reliability and/or accuracy of such apparatus is critical, the prior art pressure transducers have not been found to be entirely satisfactory due to the structural arrangement of multiple pressure sensing members, interconnecting levers, springs and the like as well as a necessity for liberal use of fluid seals which tend to make such prior art transducers bulky, heavy and difficult to calibrate.

SUMMARY OF THE INVENTION

The present invention relates to a fluid pressure transducer having a sealed fluid filled volume defined by two variable volume chambers responsive to first and second input fluid pressures and having a differential volume relationship and vented to a third variable volume chamber, the fluid pressure in which varies as a function of the first input fluid pressure modified by the pressure ratio relationship between the first input fluid pressure and the second input fluid pressure.

It is an object of the present invention to provide a structurally simple and reliable fluid pressure transducer for varying an output fluid pressure as a function of a first input fluid pressure and the pressure ratio between a second input fluid pressure and the first input fluid pressure.

It is an object of the present invention to provide a fluid pressure transducer having a sealed fluid chamber defined, in part, by a plurality of variable volume fluid chambers, first and second of which chambers are responsive to externally applied first and second pressurized fluids, respectively, a third of which chambers is responsive to the temperature of the fluid in the sealed chamber and a fourth of which chambers is responsive to the pressure in said chamber to produce an output signal as a function of the first pressurized fluid and the pressure ratio of the first and second pressurized fluids regardless of temperature variations of the fluid in the sealed chamber.

Other objects and advantages of the present invention will be apparent from the following description and accompanying drawings.

BRIEF DESCRIPTION OF THE DRAWING

The drawing represents a schematic sectional view of the present invention.

DESCRIPTION OF THE INVENTION

Referring to the drawing, numeral 10 designates a casing defining chambers 12 and 14 having inlet ports 16 and 18, respectively, and separated by a wall 20. The inlet ports 16 and 18 are vented to respective sources of pressurized fluid, not shown, at variable pressures $P_1$ and $P_2$ which may be termed sensed input signals. An input bellows 22 anchored at one end to wall 20 by any suitable means providing a fluid seal 24 such as brazing has an opposite sealed free end 26 of predetermined mean effective area $A_2$ exposed to pressurized fluid $P_2$ in chamber 14. An input bellows 28 anchored at one end to wall 20 by any suitable means providing a fluid seal 30 such as brazing has an opposite sealed free end 32 of predetermined mean effective area $A_1$ exposed to pressurized fluid $P_1$ in chamber 12. The free or movable ends 26 and 32 are joined by a rod or strut 34 fixedly secured thereto. Strut 34 is coaxially arranged with bellows 22 and 28 and extends through an opening 36 in wall 20. The bellows 22 and 28 define a variable volume chamber 38 vented via a passage 40 to a port 42 which, in turn, is connected via a passage 44 to a port 46 in a casing 48 of a control unit generally indicated by 50 and remotely located relative to casing 10. The port 46 communicates with the interior of an output bellows 52 anchored at one end to casing 48 by any suitable means providing a fluid seal 54 such as brazing and provided with an opposite sealed free end 56. A damping restriction 58 is suitably located in passage 44 to control flow therethrough.

The free end 56 of output bellows 52 bears against one end of a lever 60 pivotally secured to a fixed support 62. A servo valve 64 adjustably secured to the opposite end of lever 60 by a stem 66 threadedly secured to lever 60 and locked in a given position by lock nut 68 is adapted to cooperate with a valve seat 70 at the discharge end of a passage 72 leading from a chamber 74. A differential area piston 76 slidably contained by chamber 74 is provided with a reduced diameter portion 78 which extends through an opening 80 in an end wall of chamber 74. The piston 76 divides chamber 74 into variable volume chambers 82 and 84 which communicate via a fixed restriction 86 threadedly or otherwise fixedly secured in position in piston 76. Fluid at a regulated constant pressure $P_R$ is supplied chamber 82 via a passage 88 from a conventional fluid pressure regulating apparatus, not shown, forming part of control unit 50 which control unit may be a combustion engine fuel control in which case the fluid at regulated pressure may be a liquid fuel. The piston 76 actuating forces are derived from relatively low drain fluid pressure $P_O$ acting against the small effective end area $A_3$ of reduced diameter portion 78 plus the regulated pressure $P_R$ acting against intermediate effective annular area $A_4$ of piston 78 acting in opposition to servo valve 64 controlled pressure $P_x$ acting against relatively large area $A_5$ of piston 76. A compression spring 90 interposed between reduced diameter portion 28 and lever 60 acts in opposition to the output bellows 52.

A bellows 92 anchored at one end to casing 10 by any suitable means providing a fluid seal 94 such as brazing is vented interiorly to passage 40 via a port 96. The exterior of bellows 92 is exposed to chamber 12 at pressure $P_1$ which, in addition to a compression spring 98 interposed between free end 97 of bellows 92 and casing 10, loads bellows 92 in opposition to pressure $P_3$ within bellows 92 and a plurality of conventional temperature responsive capsules or discs 100 interposed between free end 97 and casing 10. The capsules or discs 100 are temperature responsive to the fluid within bellows and expand and contract with a temperature increase and decrease, respectively, thereby causing a corresponding expansion or contraction of bellows 92. The spring load exerted by spring 98 is selected to be greater than the maximum force derived from pressure differential $P_3 - P_1$ acting across the mean effective end area $A_6$ of bellows 92 thereby making the response of bellows 92 a function of temperature change only.

In operation, the output position of piston 76 is dependent upon the pressure $P_3$ of the fluid within the sealed volume which pressure $P_3$ varies as a predetermined function of input pressure $P_1$ and the ratio, $P_2/P_1$ of the input Pressures $P_1$ and $P_2$. This is evident from the force balance or force summation relationship:

(1) $\Sigma F = O = P_1 A_1 - P_3 (A_1 - A_{34}) + P_3 (A_2 - A_{34}) - P_2 A_2$ wherein $A_{34}$ designates the cross sectional area of strut 34. Equation (1) reduces to (2) $P_3 (A_1 - A_2) = P_1 A_1 - P_2 A_2$ which indicates that the area $A_{34}$ of strut 34 is eliminated from consideration. Equation (2) may be translated and becomes $$P_3 = \frac{P_1 A_1 - P_2 A_2}{A_1 - A_2} \quad \text{or} \quad P_1 \left[ \frac{A_1 - A_2 \left( \frac{P_2}{P_1} \right)}{A_1 - A_2} \right] \qquad (3)$$

wherein it will be recognized that the areas $A_1$ and $A_2$ are fixed such that $P_1$ and $P_2/P_1$ are the only variables upon which the pressure $P_3$ depends.

Assuming the bellows 22, 28 and 52 and the pressured fluids $P_1$, $P_2$ and $P_3$ to be in a stable state, an increase in input pressure $P_1$ or a decrease in input pressure $P_2$ will upset the bellows 22 and 28 simultaneously by virtue of the rigid strut 34 connecting the free or movable ends 26 and 32 of the bellows 22 and 28, respectively, causing a decrease in volume of bellows 28 and an increase in volume of bellows 22. Since the mean effective area of bellows 28, as shown, is greater than that of bellows 22 and axial displacement of movable ends 26 and 32 is the same, it is apparent that the volumetric decrease of bellows 28 is greater than the volumetric increase of bellows 22 resulting in compression of the fluid upstream from the damping restriction 58 and subsequent flow therethrough into output bellows 52. The resulting expansion of bellows 52 in response to the pressurized fluid $P_3$ upsets lever 60 in a clockwise direction as viewed in the drawing causing servo valve 60 to move toward valve seat 70 which, in turn, causes an increase in pressure $P_x$ acting against piston 76. The piston 76 is driven toward bellows 52 thereby compressing spring 90 and increasing the position feedback force imposed against lever 60 in opposition to bellows 52 resulting in a force balance on lever 60 and subsequent stabilization of servo valve 64 and thus pressure $P_x$ acting against area $A_5$ of piston 76. It will be recognized that the floating piston 76 is stabilized at a pressure $P_x$ which corresponds to the ratio relationship of pressure $P_x$, $P_R$ and $P_O$ established by the ratio relationship of areas $A_3$, $A_4$ and $A_5$ of piston 76.

The piston 76 may be provided with suitable position responsive means such as a rod or stem 102 suitably secured thereto and slidably extending through the end wall of chamber 84 into engagement with mating linkage, not shown, associated with control unit 50.

It will be understood that a decrease in input pressure $P_1$ or an increase in input pressure $P_2$ will upset bellows 22 and 28 in the opposite sense relative to that described above whereupon the resulting increase in volume of bellows 28 and decrease in volume of bellows 22 will produce a decrease in pressure $P_3$ and a corresponding contraction of output bellows 52 which, in turn, results in movement of piston 76 away from output bellows 52. The spring 90 is relaxed thereby reducing the position feedback force imposed on lever 60 to effect a force balance on lever 60 thereby stabilizing piston 76 in the heretofore mentioned manner.

In the event of a change in temperature of the pressurized fluid $P_3$ the capsules or discs 100 will said or contract depending upon the relative temperature change causing bellows 92 to expand or contract accordingly. The resulting decrease or increase in pressure $P_3$ compensates for the temperature effect on volume of the pressurized fluid thereby maintaining the pressure $P_3$ at a constant value regardless of the temperature of the fluid.

The desirable characteristics of the above described fluid pressure transducer include:

(1) the output pressure $P_3$ may be greater than either of the input pressures $P_1$ or $P_2$; (2) the sealed volume defined by bellows 22, 28, 52 and 92 may be filled with liquid and the input pressures $P_1$ and $P_2$ derived from gas or liquid or a combination of gas and liquid; (3) the bellows 22, 28, 52 and 92 separate fluids at different pressures and provide a positive seal against leakage therebetween; (4) no sliding motion is involved thereby eliminating frictional drag and thus hysteresis effects and (5) as shown in the drawing, the output bellows 52 may be remotely located relative to the input bellows 22, 28 and the necessary fluid connection therebetween made by a single flexible passage thereby simplifying location in troublesome environments where available space is at a minimum or environmental temperature and/or pressures are critical such as combustion engines and the like. However, in the event that integration of component structure is desired, the control unit 50 may be suitably chambered to house the bellows 22, 28 and 92.

Various changes and modifications in the above described apparatus may be made without departing from the scope of applicant's invention as defined by the following claims.

I claim:

1. Fluid pressure responsive transducer apparatus comprising:

a first input bellows exteriorly exposed and responsive to a first pressurized fluid and having a first predetermined internal volume;

a second input bellows exteriorly exposed and responsive to a second pressurized fluid and having a second predetermined internal volume;

an output bellows vented interiorly to the interior of said first and second bellows and together therewith defining a sealed volume of fluid;

a strut member fixedly secured at opposite ends to movable ends of said first and second bellows for maintaining the same in fixed spaced apart relationship;

said first and second predetermined internal volumes being of different capacity and simultaneously variable in response to pressure variations of at least one of said first and second pressurized fluids to thereby internally pressurize said output bellows as a predetermined function of said first and second pressurized fluids.

2. Fluid pressure responsive transducer apparatus as claimed in claim 1 wherein:

said first and second input bellows are coaxially arranged.

3. Fluid pressure responsive transducer apparatus as claimed in claim 1 wherein said strut is coaxially arranged with said first and second bellows.

4. Fluid pressure responsive transducer apparatus as claimed in claim 1 wherein:

said output bellows is responsive to said internal pressurization thereof and operative to produce an output force for control purposes.

5. Fluid pressure responsive transducer apparatus as claimed in claim 1 and further including:

a compensating bellows vented interiorly to said sealed volume of fluid and housing temperature responsive means responsive to the temperature of the fluid within said compensating bellows;

said temperature responsive means being operatively connected to said compensating bellows to cause expansion and contraction and thus volume change of said sealed volume of fluid to compensate for pressure variations thereof caused by temperature changes of said sealed volume of fluid.

6. Fluid pressure responsive transducer apparatus as claimed in claim 1 wherein:

said output bellows is remotely located relative to said first and second input bellows and provided with passage means connecting the interior of said output bellows with the interior of said first and second input bellows.

7. Fluid pressure responsive transducer apparatus as claimed in claim 1 and further including:

a flow restriction in said passage means for restricting fluid flow into and out of said output bellows.

8. Fluid pressure responsive transducer apparatus as claimed in claim 5 wherein:

said compensating bellows is exposed exteriorly to said first pressurized fluid; and spring means operatively connected to said compensating bellows for imposing a preload thereon in opposition to the fluid pressure differential acting across said compensating bellows.

9. Fluid pressure responsive transducer apparatus as claimed in claim 5 wherein:

said temperature responsive means is a plurality of temperature responsive capsules interposed between a fixed support and a movable end of sai compensating bellows.

10. Fluid pressure responsive transducer apparatus as claimed in claim 1 wherein:

said output bellows is internally pressurized as a function of said first pressurized fluid and the ratio of said first and second pressurized fluids.

* * * * *